US008011030B2

(12) United States Patent
Li

(10) Patent No.: US 8,011,030 B2
(45) Date of Patent: Sep. 6, 2011

(54) POP-UP STOPPER HAVING DRAINING AND STRAINING FUNCTIONS

(75) Inventor: Yi-Chun Li, Kaohsiung (TW)

(73) Assignee: Thank Enterprise Co., Ltd., Kaohsiung (TW)

( * ) Notice: Subject to any disclaimer, the term of this patent is extended or adjusted under 35 U.S.C. 154(b) by 490 days.

(21) Appl. No.: 12/235,909

(22) Filed: Sep. 23, 2008

(65) Prior Publication Data

US 2010/0071122 A1 Mar. 25, 2010

(51) Int. Cl.
*E03C 1/26* (2006.01)

(52) U.S. Cl. ..... 4/287; 4/286; 4/295

(58) Field of Classification Search ..... 4/222.1, 4/232, 286–295, 507, 510, 512, 650, DIG. 19; 210/163, 459, 499; D23/260–261
See application file for complete search history.

(56) References Cited

U.S. PATENT DOCUMENTS

| | | | | | |
|---|---|---|---|---|---|
| 834,431 | A * | 10/1906 | Williams | 210/448 |
| 1,014,223 | A * | 1/1912 | Hunsicker | 4/291 |
| 2,075,443 | A * | 3/1937 | Kirschner et al. | 4/287 |
| 2,079,038 | A * | 5/1937 | Ranish | 4/291 |
| 2,429,435 | A * | 10/1947 | Vartanian | 4/287 |
| 6,276,000 | B1 * | 8/2001 | Saman et al. | 4/287 |
| 2004/0073992 | A1 * | 4/2004 | Saman et al. | 4/287 |
| 2008/0178382 | A1 * | 7/2008 | Pinette et al. | 4/689 |

* cited by examiner

*Primary Examiner* — Len Tran
*Assistant Examiner* — Jeffrey Dunn
(74) *Attorney, Agent, or Firm* — Alan Kamrath; Kamrath & Associates PA

(57) ABSTRACT

A pop-up stopper includes a main body having an inside provided with a receiving space and a periphery provided with a plurality of through holes, a control unit removably mounted on a top of the main body and including a top cap and a plurality of connecting members, and a bottom cap removably mounted on a bottom of the main body. Each of the connecting members includes at least one upper elastic plate having a protrusion and at least one lower elastic plate having a protrusion. Thus, the stopper has draining and straining functions to achieve a sanitary effect. In addition, the control unit and the bottom cap can be mounted on and detached from the main body easily and quickly, thereby facilitating a user assembling and disassembling the stopper.

17 Claims, 6 Drawing Sheets

POP-UP STOPPER HAVING DRAINING AND STRAINING FUNCTIONS

BACKGROUND OF THE INVENTION

1. Field of the Invention

The present invention relates to a stopper and, more particularly, to a pop-up stopper for a bathroom, sink and the like.

2. Description of the Related Art

A conventional pop-up stopper comprises a cup-shaped barrel having an inside provided with a receiving space and a periphery provided with a plurality of through holes each connected to the receiving space. The stopper can be mounted in a sink. The sink has a bottom provided with a mounting chamber which has a top provided with a stepped portion and a bottom connected to a drain pipe. The barrel of the stopper is mounted in the mounting chamber of the sink and has a top provided with a protruding flange resting on the stepped portion of the sink. Thus, the water in the sink in turn flows through the receiving space and the through holes of the barrel into the drain pipe and is drained from the drain pipe. In addition, larger items, such as food dregs and the like, are stopped by the barrel and stored in the receiving space of the barrel.

BRIEF SUMMARY OF THE INVENTION

In accordance with the present invention, there is provided a stopper, comprising a main body having an inside provided with a receiving space and a periphery provided with a plurality of through holes each connected to the receiving space, a control unit removably mounted on a top of the main body and including a top cap and a plurality of connecting members, and a bottom cap removably mounted on a bottom of the main body. The connecting members are arranged on a bottom of the top cap, and bottoms of the connecting members are connected together by a connection. Each of the connecting members includes at least one upper elastic plate and at least one lower elastic plate. The at least one upper elastic plate of each of the connecting members has a protrusion directed outwardly relative to the top cap. The at least one lower elastic plate of each of the connecting members has a protrusion directed outwardly relative to the top cap.

The primary objective of the present invention is to provide a pop-up stopper having draining and straining functions to achieve a sanitary effect.

Another objective of the present invention is to provide a stopper, wherein the control unit and the bottom cap can be mounted on and detached from the main body easily and quickly, thereby facilitating a user assembling and disassembling the stopper.

A further objective of the present invention is to provide a stopper, wherein the a deodorizing agent is mounted between the main body and the bottom cap to prevent the odor of the drain pipe from flowing backward so as to refresh the air.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
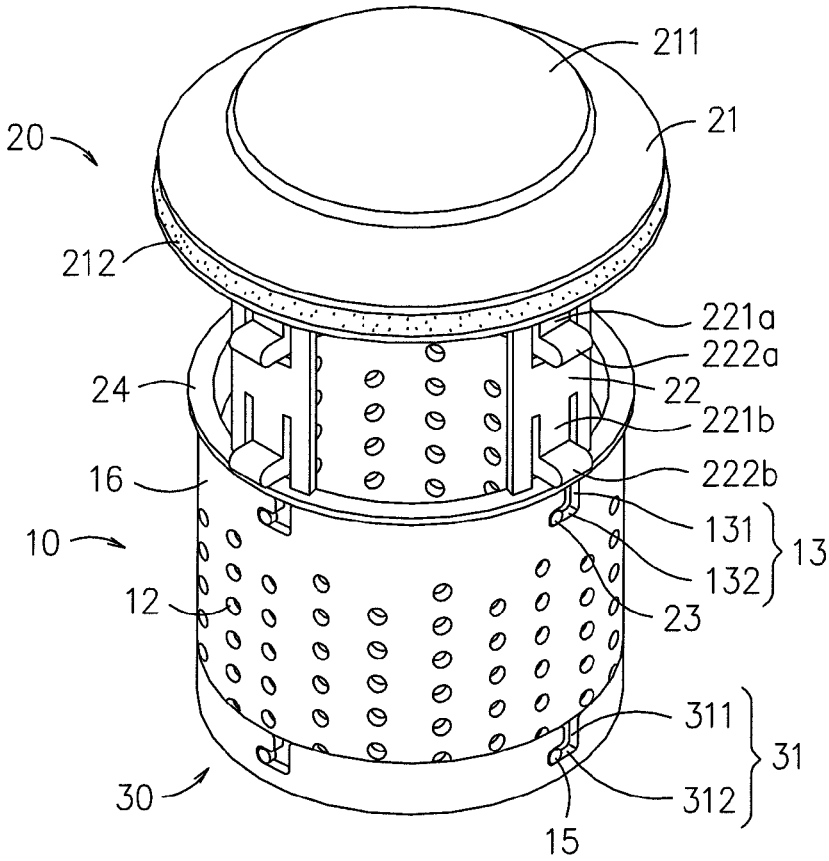
FIG. 1 is a perspective view of a stopper in accordance with the preferred embodiment of the present invention.

Referring to the drawings and initially to FIGS. 1-5, a pop-up stopper in accordance with the preferred embodiment of the present invention comprises a main body 10, a control unit 20 and a bottom cap 30.

The main body 10 has an inside provided with a receiving space 11 and a periphery provided with a plurality of through holes 12 each connected to the receiving space 11. The main body 10 has a top provided with a plurality of locking grooves 13. Each of the locking grooves 13 of the main body 10 includes a vertical slot 131 extending through the top of the main body 10 and a horizontal slot 132 connected to the vertical slot 131. The main body 10 has a bottom provided with a recess 14 extending toward the receiving space 11 of the main body 10. The recess 14 of the main body 10 has a periphery provided with at least one connecting hole 141 connected to the receiving space 11.

The control unit 20 is removably mounted on a top of the main body 10 and includes a disk-shaped top cap 21 and a plurality of (or four) connecting members 22. The top cap 21 has a top provided with a recessed grip portion 211 which has a flat circular shape and has a height greater than that of the top of the top cap 21. An O-ring 212 (made of rubber) is mounted on a periphery of the top cap 21. The top cap 21 functions as a center of the connecting members 22. The connecting members 22 are arranged on a bottom of the top cap 21 in an annular manner and are equally spaced from each other. Each of the connecting members 22 extends from the bottom of the top cap 21 through a determined length, and bottoms of the connecting members 22 are connected together by a connection 223. Each of the connecting members 22 includes at least one upper elastic plate 221*a* and at least one lower elastic plate 221*b*. The at least one upper elastic plate 221*a* of each of the connecting members 22 has a protrusion 222*a* directed outwardly relative to the top cap 21. The at least one lower elastic plate 221*b* of each of the connecting members 22 has a protrusion 222*b* directed outwardly relative to the top cap 21. The protrusion 222*a* of the at least one upper elastic plate 221*a* and the protrusion 222*b* of the lower elastic plate 221*b* of each of the connecting members 22 are located at different height and protrude outwardly from an outer wall 16 of the main body 10. The connection 223 connecting the connecting members 22 has a periphery provided with a plurality of locking stubs 23 each detachably locked in a respective one of the locking grooves 13 of the main body 10, and an annular flange 24 located above the locking stubs 23.

Figure 4:
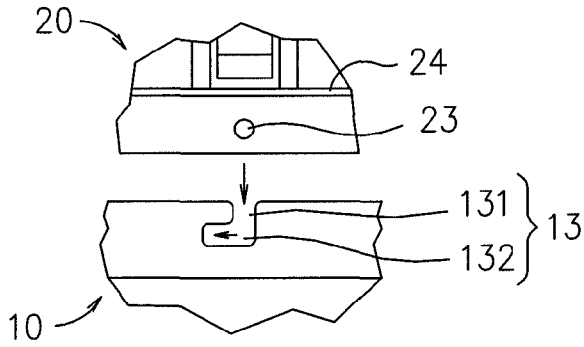
FIG. 4 is a partially front exploded view of the stopper as shown in FIG. 2.
Figure 5:
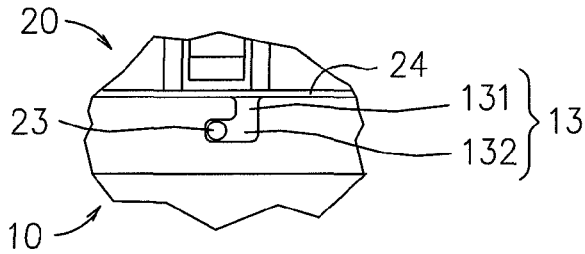
FIG. 5 is a front assembly view of the stopper as shown in FIG. 4.

As shown in FIGS. 4 and 5, each of the locking stubs 23 of the control unit 20 is in turn inserted through the vertical slot 131 into the horizontal slot 132 of a respective one of the locking grooves 13 of the main body 10 by rotation of the control unit 20 relative to the main body 10 to combine the control unit 20 with the main body 10. At this time, the annular flange 24 of the control unit 20 abuts the top of the main body 10. On the contrary, each of the locking stubs 23 of the control unit 20 is in turn detached from the horizontal slot 132 and the vertical slot 131 of the respective locking groove 13 of the main body 10 by rotation of the control unit 20 relative to the main body 10 in the opposite direction to detach the control unit 20 from the main body 10.

Figure 2:
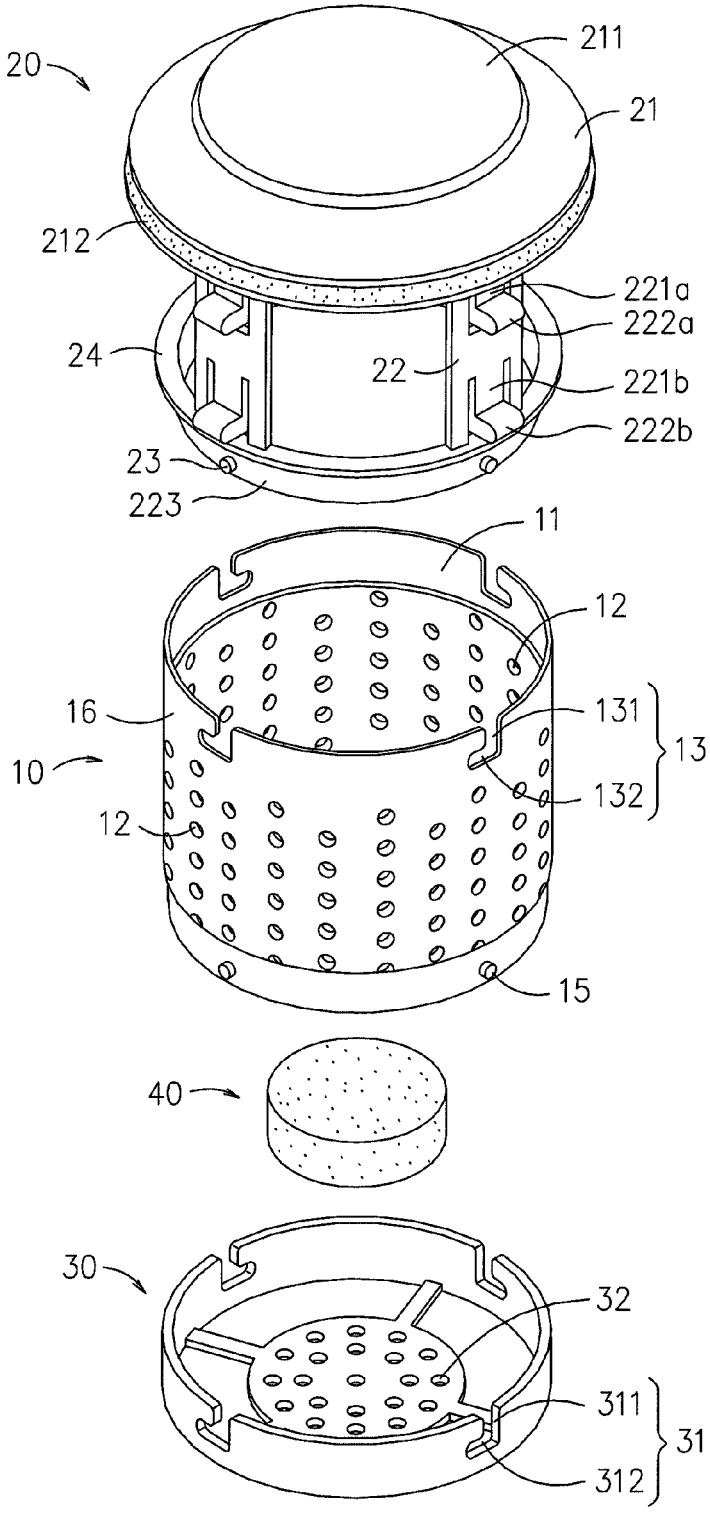
FIG. 2 is an exploded perspective view of the stopper as shown in FIG. 1.

As shown in FIGS. 1 and 2, the bottom cap 30 is removably mounted on a bottom of the main body 10 and has a top provided with a plurality of retaining grooves 31. Each of the retaining grooves 31 of the bottom cap 30 includes a vertical slot 311 extending through the top of the bottom cap 30 and a horizontal slot 312 connected to the vertical slot 311. The bottom of the main body 10 has a periphery provided with a plurality of retaining stubs 15 each detachably locked in a respective one of the retaining grooves 31 of the bottom cap 30. In assembly, each of the retaining stubs 15 of the main body 10 is in turn inserted through the vertical slot 311 into the horizontal slot 312 of a respective one of the retaining grooves 31 of the bottom cap 30 by rotation of the bottom cap 30 relative to the main body 10 to combine the bottom cap 30 with the main body 10. On the contrary, each of the retaining stubs 15 of the main body 10 is in turn detached from the horizontal slot 312 and the vertical slot 311 of the respective retaining groove 31 of the bottom cap 30 by rotation of the bottom cap 30 relative to the main body 10 in the opposite direction to detach the bottom cap 30 from the main body 10.

Figure 3:
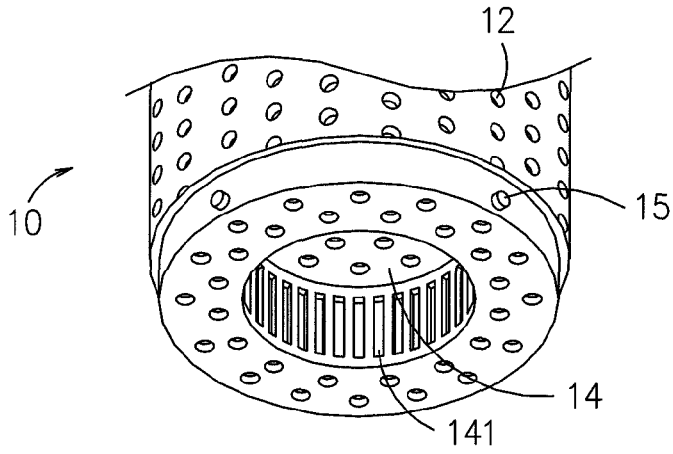
FIG. 3 is a partially bottom perspective view of a main body of the stopper as shown in FIG. 2.

As shown in FIGS. 2 and 3, the bottom cap 30 has a face provided with a plurality of through bores 32 each connected to the recess 14 of the main body 10, and the pop-up stopper further comprises a deodorizing agent 40 mounted between the main body 10 and the bottom cap 30 and received in the recess 14 of the main body 10. The deodorizing agent 40 has a block shape or a granular shape.

Figure 6:
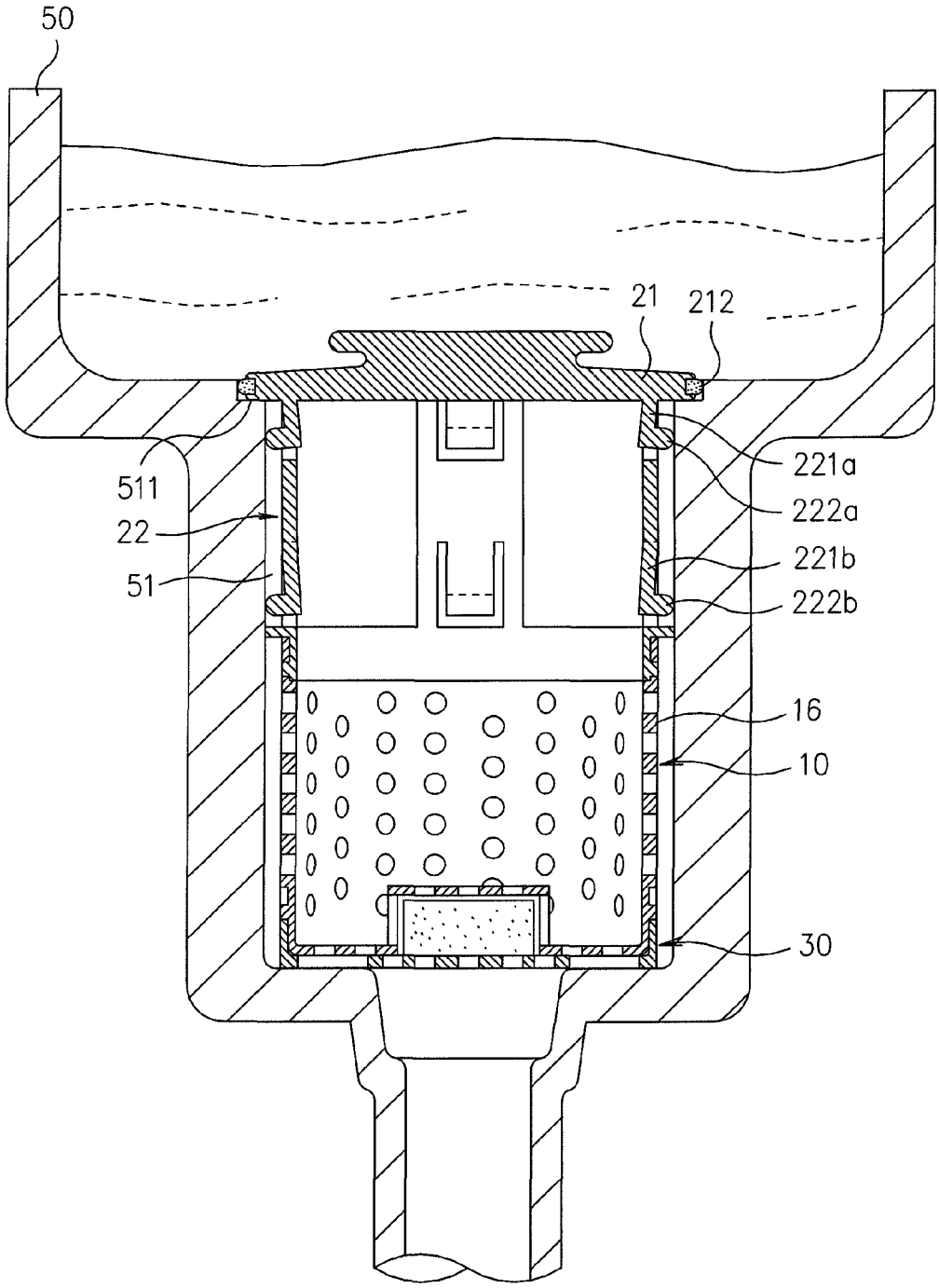
FIG. 6 is a front cross-sectional view of the stopper for a sink as shown in FIG. 1.

In practice, referring to FIG. 6 with reference to FIGS. 1-5, the pop-up stopper is mounted in a sink 50. The sink 50 has a bottom provided with a mounting chamber 51 which has a top provided with a stepped portion 511 and a bottom connected to a drain pipe 52. When the main body 10 is inserted into the mounting chamber 51 of the sink 50, the protrusion 222*a* of the at least one upper elastic plate 221*a* and the protrusion 222*b* of the lower elastic plate 221*b* of each of the connecting members 22 are compressed inward by the wall of the mounting chamber 51 of the sink 50, so that the at least one upper elastic plate 221*a* and the lower elastic plate 221*b* of each of the connecting members 22 are retracted inward to seal the mounting chamber 51 of the sink 50. Thus, the main body 10 and the bottom cap 30 are sealed in the mounting chamber 51 of the sink 50. At this time, the top cap 21 abuts the stepped portion 511 of the sink 50, and the O-ring 212 on the top cap 21 seals the stepped portion 511 of the sink 50, so that the bottom of the sink 50 is sealed and the sink 50 can be used to store the water.

Figure 7:
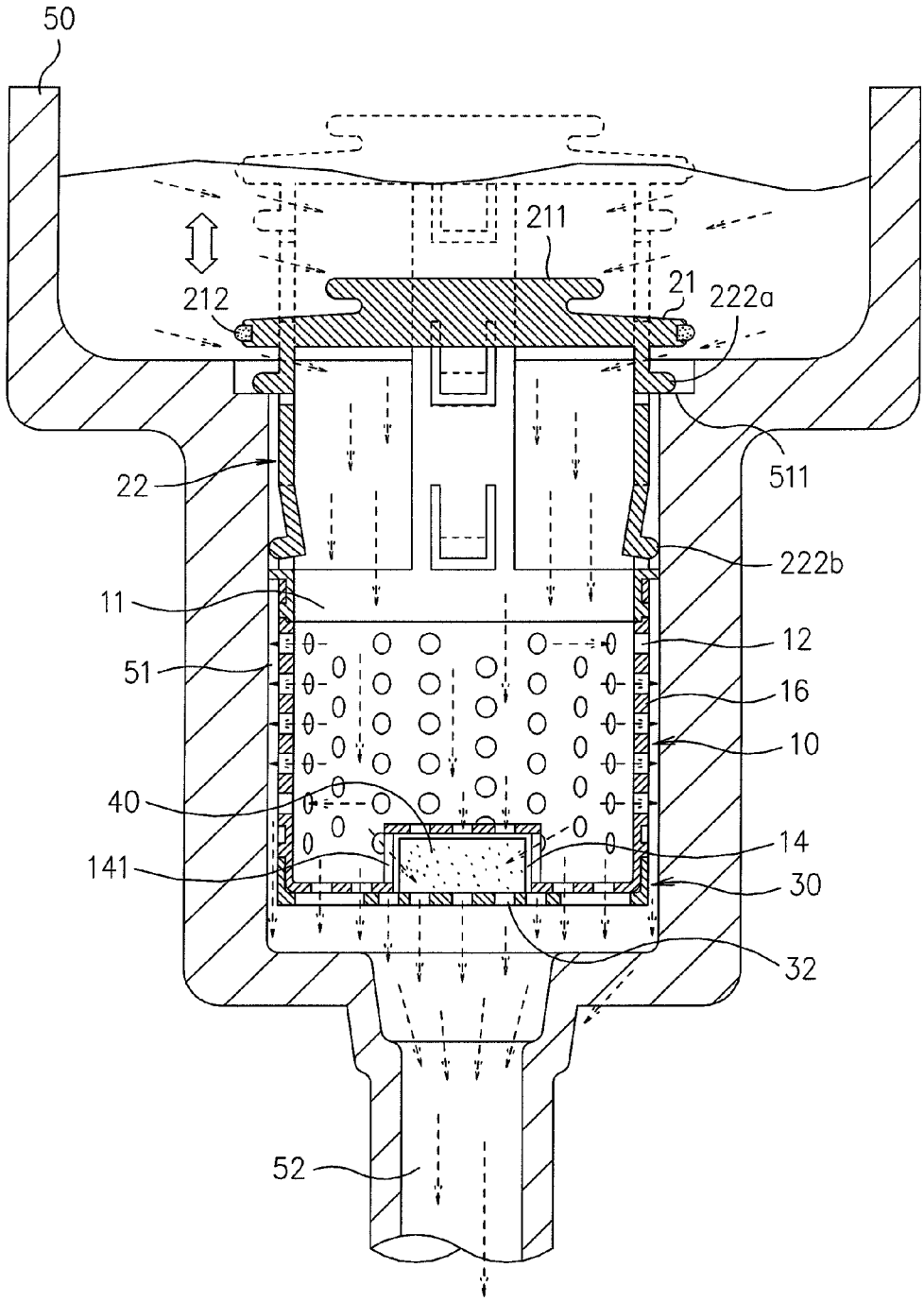
FIG. 7 is a schematic operational view of the stopper as shown in FIG. 6 in use.

In operation, referring to FIG. 7 with reference to FIGS. 1-5, the grip portion 211 of the top cap 21 is pulled upward by a user to move the top cap 21 of the control unit 20, the main body 10 and the bottom cap 30 upward relative to the mounting chamber 51 of the sink 50. At this time, the protrusion 222*a* of the at least one upper elastic plate 221*a* and the protrusion 222*b* of the lower elastic plate 221*b* of each of the connecting members 22 are located at different height, so that when the main body 10 is moved upward relative to the mounting chamber 51 of the sink 50, the protrusion 222*a* of the at least one upper elastic plate 221*a* of each of the connecting members 22 protrudes outwardly from an outer wall 16 of the main body 10 by its elastic force and abuts the stepped portion 511 of the sink 50, while the protrusion 222*b* of the lower elastic plate 221*b* of each of the connecting members 22 is compressed by the wall of the mounting chamber 51 of the sink 50 to seal the mounting chamber 51 of the sink 50. At the same time, the O-ring 212 on the top cap 21 is detached from the stepped portion 511 of the sink 50, so that the water in the sink 50 in turn flows through the control unit 20, the receiving space 11, the through holes 12, the at least one connecting hole 141 and the recess 14 of the main body 10, and the through bores 32 of the bottom cap 30 into the drain pipe 52 and is drained from the drain pipe 52. In addition, larger items, such as food dregs and the like, are stopped by the main body 10 and stored in the receiving space 11 of the main body 10.

Figure 8:
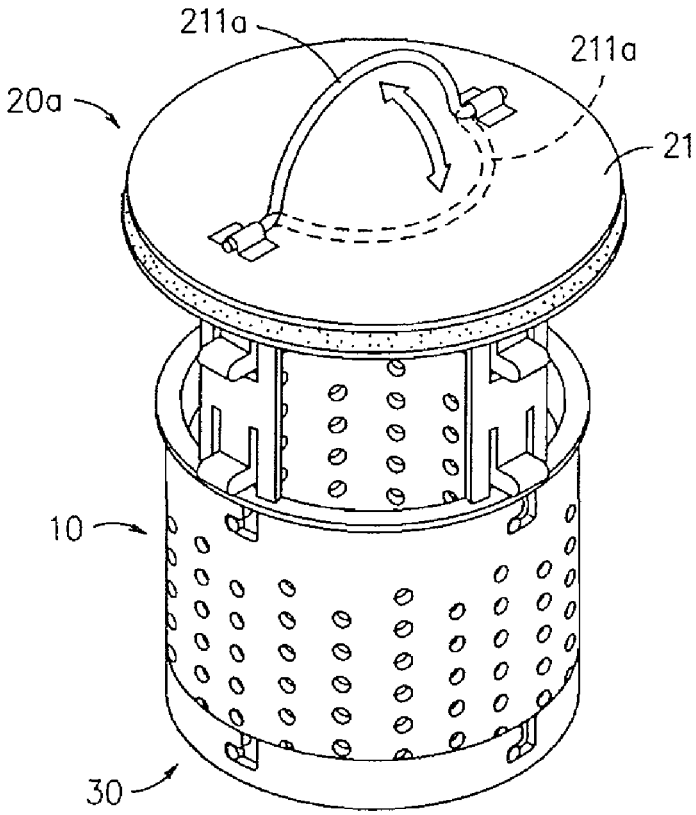
FIG. 8 is a perspective view of a stopper in accordance with another preferred embodiment of the present invention.

Referring to FIG. 8, the grip portion 211*a* has a substantially arc-shaped profile and has two opposite ends pivotally mounted on the top cap 21 of the control unit 20*a* to facilitate a user holding the grip portion 211*a*.

As shown in FIG. 2, the protrusion 222*a* is located at a bottom of the at least one upper elastic plate 221*a* of each of the connecting members 22, and the protrusion 222*b* is located at a bottom of the lower elastic plate 221*b* of each of the connecting members 22.

Figure 9:
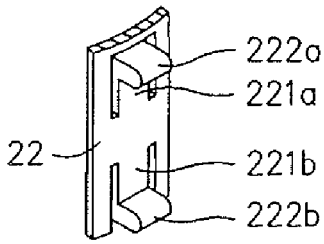
FIG. 9 is a partially perspective view of a connecting member of the stopper in accordance with another preferred embodiment of the present invention.

As shown in FIG. 9, the protrusion 222*a* is located at a top of the at least one upper elastic plate 221*a* of each of the connecting members 22, and the protrusion 222*b* is located at a bottom of the lower elastic plate 221*b* of each of the connecting members 22.

Figure 10:
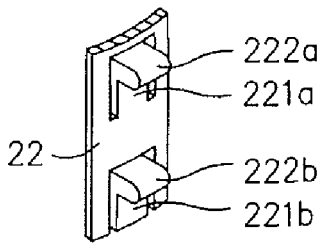
FIG. 10 is a partially perspective view of a connecting member of the stopper in accordance with another preferred embodiment of the present invention.

As shown in FIG. 10, the protrusion 222*a* is located at a top of the at least one upper elastic plate 221*a* of each of the connecting members 22, and the protrusion 222*b* is located at a top of the lower elastic plate 221*b* of each of the connecting members 22.

Accordingly, the stopper has draining and straining functions to achieve a sanitary effect. In addition, the control unit 20 and the bottom cap 30 can be mounted on and detached from the main body 10 easily and quickly, thereby facilitating a user assembling and disassembling the stopper. Further, the a deodorizing agent 40 is mounted between the main body 10 and the bottom cap 30 to prevent the odor of the drain pipe 52 from flowing backward so as to refresh the air.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A stopper, comprising:

a main body having an inside provided with a receiving space and a periphery provided with a plurality of through holes each connected to the receiving space;

a control unit removably mounted on a top of the main body and including a top cap and a plurality of connecting members;

a bottom cap removably mounted on a bottom of the main body;

wherein the connecting members are arranged on a bottom of the top cap;

bottoms of the connecting members are connected together by a connection;

each of the connecting members includes at least one upper elastic plate and at least one lower elastic plate;

the at least one upper elastic plate of each of the connecting members has a protrusion directed outwardly relative to the top cap;

the at least one lower elastic plate of each of the connecting members has a protrusion directed outwardly relative to the top cap.

2. The stopper in accordance with claim 1, wherein the main body has a top provided with a plurality of locking grooves;

each of the locking grooves of the main body includes a vertical slot extending through the top of the main body and a horizontal slot connected to the vertical slot;

the connection connecting the connecting members has a periphery provided with a plurality of locking stubs each detachably locked in a respective one of the locking grooves of the main body;

each of the locking stubs of the control unit is in turn inserted through the vertical slot into the horizontal slot of a respective one of the locking grooves of the main body by rotation of the control unit relative to the main body to combine the control unit with the main body.

3. The stopper in accordance with claim 2, wherein the periphery of the connection is provided with an annular flange located above the locking stubs and abutting the top of the main body when the control unit is combined with the main body.

4. The stopper in accordance with claim 1, wherein the bottom cap has a top provided with a plurality of retaining grooves;

each of the retaining grooves of the bottom cap includes a vertical slot extending through the top of the bottom cap and a horizontal slot connected to the vertical slot;

the bottom of the main body has a periphery provided with a plurality of retaining stubs each detachably locked in a respective one of the retaining grooves of the bottom cap;

each of the retaining stubs of the main body is in turn inserted through the vertical slot into the horizontal slot of a respective one of the retaining grooves of the bottom cap by rotation of the bottom cap relative to the main body to combine the bottom cap with the main body.

5. The stopper in accordance with claim 1, wherein the top cap is disk-shaped;

the top cap functions as a center of the connecting members;

the connecting members are arranged on the bottom of the top cap in an annular manner and are equally spaced from each other and;

each of the connecting members extends from the bottom of the top cap through a determined length.

6. The stopper in accordance with claim 1, wherein the top cap has a top provided with a recessed grip portion which has a flat circular shape and has a height greater than that of the top of the top cap.

7. The stopper in accordance with claim 1, wherein the top cap has a top provided with a grip portion which has a substantially arc-shaped profile and has two opposite ends pivotally mounted on the top cap of the control unit.

8. The stopper in accordance with claim 1, further comprising:

an O-ring is mounted on a periphery of the top cap.

9. The stopper in accordance with claim 1, wherein the protrusion is located at a bottom of the at least one upper elastic plate of each of the connecting members;

the protrusion is located at a bottom of the lower elastic plate of each of the connecting members.

10. The stopper in accordance with claim 1, wherein the protrusion is located at a top of the at least one upper elastic plate of each of the connecting members;

the protrusion is located at a bottom of the lower elastic plate of each of the connecting members.

11. The stopper in accordance with claim 1, wherein the protrusion is located at a top of the at least one upper elastic plate of each of the connecting members;

the protrusion is located at a top of the lower elastic plate of each of the connecting members.

12. The stopper in accordance with claim 1, wherein the protrusion of the at least one upper elastic plate and the protrusion of the lower elastic plate of each of the connecting members are located at different heights.

13. The stopper in accordance with claim 1, wherein the protrusion of the at least one upper elastic plate and the protrusion of the lower elastic plate of each of the connecting members protrude outwardly beyond an outer wall of the main body.

14. The stopper in accordance with claim 1, wherein the bottom of the main body is provided with a recess extending toward the receiving space of the main body.

15. The stopper in accordance with claim 14, wherein the bottom cap has a face provided with a plurality of through bores each connected to the recess of the main body.

16. The stopper in accordance with claim 14, wherein the recess of the main body has a periphery provided with at least one connecting hole connected to the receiving space.

17. The stopper in accordance with claim 14, further comprising:

a deodorizing agent mounted between the main body and the bottom cap and received in the recess of the main body.

* * * * *